United States Patent [19]

Panicci

[11] 4,388,996

[45] * Jun. 21, 1983

[54] SELF-RIGHTING TRAINING CUP

[75] Inventor: Richard L. Panicci, Hanover, Mass.

[73] Assignee: Kiddie Products, Inc., Avon, Mass.

[ * ] Notice: The portion of the term of this patent subsequent to Dec. 1, 1998, has been disclaimed.

[21] Appl. No.: 324,968

[22] Filed: Nov. 25, 1981

Related U.S. Application Data

[63] Continuation-in-part of Ser. No. 106,839, Dec. 26, 1979, Pat. No. 4,303,170.

[51] Int. Cl.[3] ..... A47G 19/22

[52] U.S. Cl. ..... 220/70; 220/69; 220/90.4; 215/1 R

[58] Field of Search ..... 220/69, 70, 90.2, 90.4, 220/90.6; 215/1 R, 10; 206/502, 520

[56] References Cited

U.S. PATENT DOCUMENTS

| | | | |
|---|---|---|---|
| 441,155 | 11/1890 | Gross . | |
| 2,601,767 | 7/1952 | Wall . | |
| 3,549,044 | 12/1970 | Lerner | 220/90.4 |
| 3,966,077 | 6/1976 | Jardine | 220/70 |
| 4,096,966 | 6/1978 | Korshak | 220/69 |
| 4,303,170 | 12/1981 | Panicer | 220/70 |

FOREIGN PATENT DOCUMENTS

| | | |
|---|---|---|
| 1164969 | 10/1967 | United Kingdom . |
| 1229426 | 4/1971 | United Kingdom . |

*Primary Examiner*—George E. Lowrance

[57] ABSTRACT

A weighted self-righting training cup comprises a lower hemispherical portion having a flat to define the cup bottom and an upper portion, the ratio of the diameter of the cup at the intersection of the upper and lower portions to the effective height of the upper portion determining the minimum amount of weight necessary to make the cup consistently self-right when tipped over while being filled or partially filled with liquid.

7 Claims, 3 Drawing Figures

(FOR CUP OF GENERAL SIZE AS PREFERRED EMBODIMENT
1 UNIT OF WEIGHT EQUALS ABOUT 25 GRAMS)

SELF-RIGHTING TRAINING CUP

This is a continuation in part of my U.S. patent application Ser. No. 106,839, filed Dec. 26, 1979, hereby incorporated by reference, now U.S. Pat. No. 4,303,170.

FIELD OF THE INVENTION

This invention relates to self-righting cups, e.g., training cups used by babies and small children.

BACKGROUND OF THE INVENTION

In the prior art, self-righting training cups were made by heavily weighting their bases. Despite the very substantial base weight, however, the prior art cups will not right themselves when filled.

It is a principal object of this invention to provide a training cup which is consistently self-righting even when filled. It is a further object of this invention to provide a relationship by which, based on the dimensions of the cup, the proper minimum base weight can be determined and provided.

SUMMARY OF THE INVENTION

In general, this invention features a weighted, self-righting cup having a lower portion and a upper portion; the ratio of the outer diameter of the cup at the point of intersection of the portion to the effective height of the upper portion being at least 3 and the base of the cup having a weighting member, the weight of which is effective in relation to the ratio to cause consistent self-righting when the cup is tipped.

In preferred embodiments, the ratio is preferably 5 and as determined from a plotted curve requires a base weighted member of about 30 grams resulting in an overall cup weight of less than 90 grams. The cup of the preferred embodiment consistently self-supporting when tipped even when filled, but being lightweight and easy to handle.

DESCRIPTION OF THE PREFERRED EMBODIMENT

Other objects, features and advantages of this invention will be apparent to those skilled in the art from the following detailed description of a preferred embodiment thereof, taken together with the accompanying drawings, in which.

STRUCTURE

Figure 1:
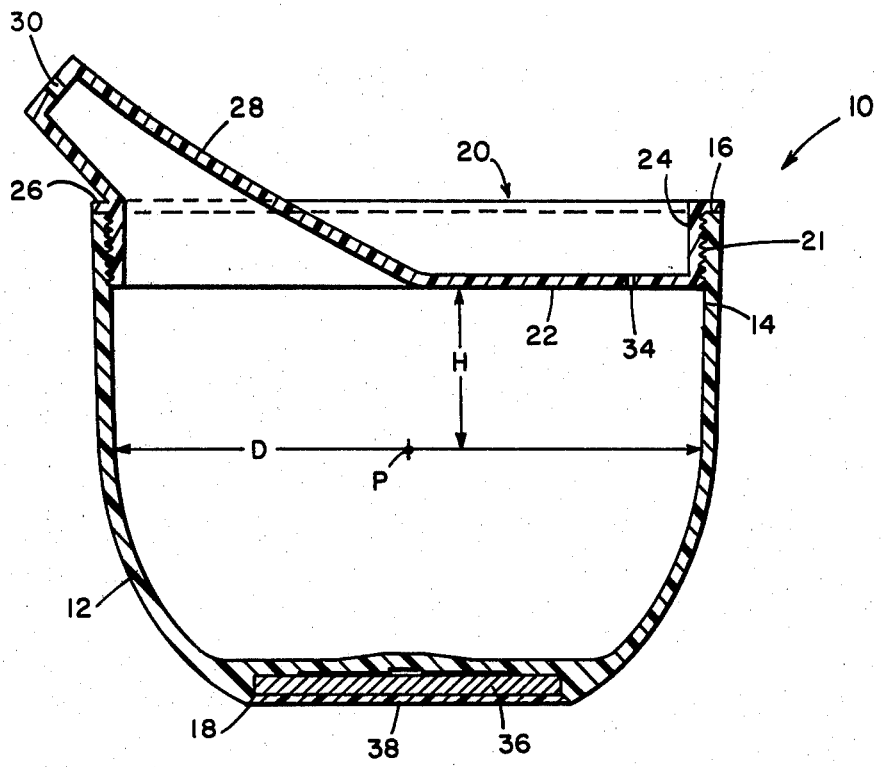
FIG. 1 is an elevation view in section of a cup made according to the invention.

As illustrated in FIG. 1, a training cup 10 according to the invention comprises integral lower and upper cup wall portions 12, 14. A removable lid 20 is sealingly secured to the rim 16 of the cup by screw threads 21, although a force fit may be used.

The lower wall portion 12 of the cup 10 is generally hemispherical having a flat 18 defining the cup bottom and extending upwardly from the bottom 18 along a radius, preferably extending from a point P on the vertical axis of the cup. The upper wall portion 14 of the cup 10 extends essentially vertically as a right cylinder from the lower wall portion 12, the upper and lower wall portions being tangent. For convenience in mold removal, the upper wall portion 14 is actually angled slightly outwardly (i.e., 1) from the vertical as it extends upwardly from the lower wall portion 12. The inner wall is screw-threaded for sealing the lid 20 to the cup 10.

Figure 2:
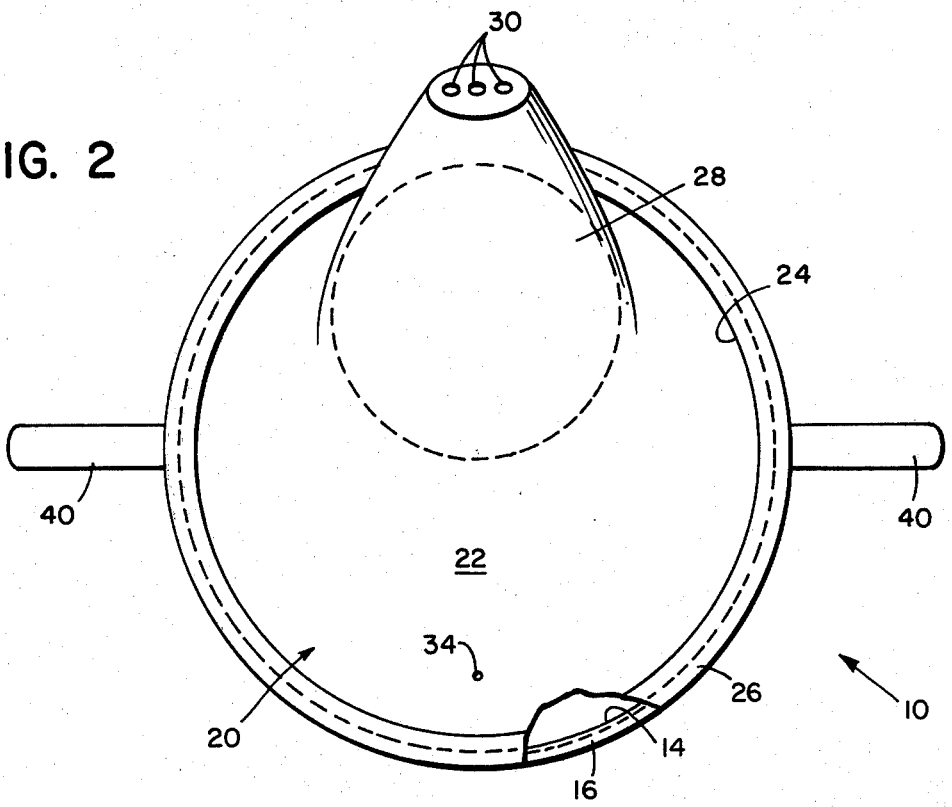
FIG. 2 is a plan view of the cup illustrated in FIG. 1.

Lid 20, as shown in FIGS. 1 and 2, comprises a transverse wall 22 extending across the upper wall portion 14 of cup 10. The lid also has an integral, vertrical screw-threaded, side wall 24 sealingly engaging the screw-threads on the inside of upper wall portion 14. The lid 20 also has a lip 26 about wall 24 for engaging cup rim 16. An integral drinking spout 28 having three openings 30 is formed on one side of lid 20. A vent hole 34 is formed in lid 20 opposite spout 28.

Figure 3:
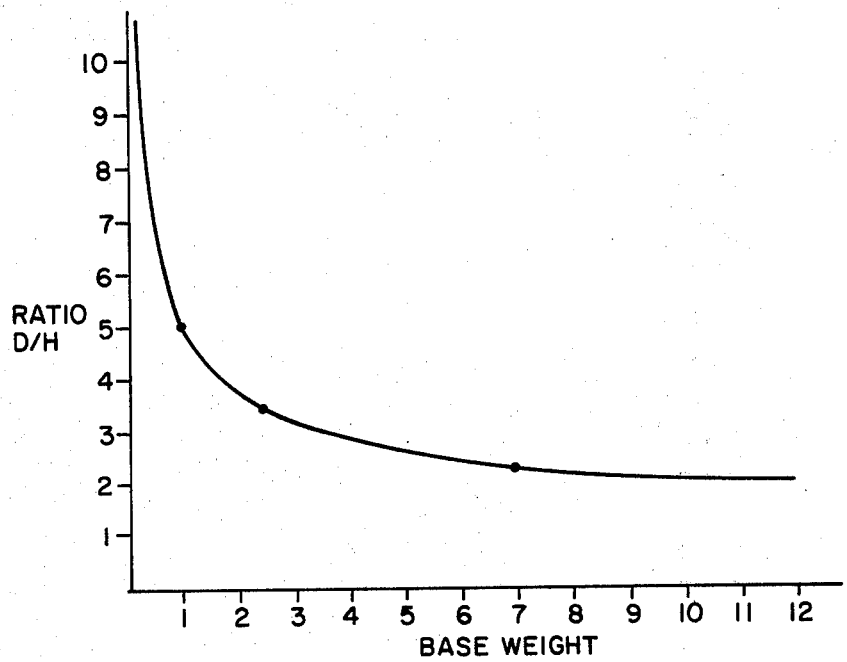
FIG. 3 is a graph of the diameter to effective height ratio v. base weight.

If the effective height H of the cylindrical upper portion 14 is limited relative to the diameter D (through point P) at the intersection of the upper and lower portions 12, 14, the cup will have a self-righting tendency, even when filled with liquid. The effective height H for this purpose is measured from the intersection of the upper and lower portions, (at the end of the curvature of the hemispherical lower portion), to the bottom of the lid 20. In the illustrated embodiments, the ratio is at least 4, and preferably greater, e.g., in the range of 4–5, to provide such self-righting ability. As shown in the graph of FIG. 3, the higher the ratio of the diameter D to the effective height H of the upper portion 14, the less base weight required to assure that the cup will self-right at all degrees of fill. The graph is an exponential curve, approaching zero base weight for high D/H ratios and leveling off at about a D/H ratio of 2.0, indicating the need for a very great base weight. The graph also indicates that at the 2.5 ratio of most prior art cups, so much base weight would be required that the cup would be unacceptably heavy. But at a ratio of 5, little weight is required. At a ratio of about 4.0, the curve begins and the base weight required increases dramatically.

In the preferred embodiment, the outer diameter of the lower portion of the cup 10 is 3.250 inches and the effective height of the upper portion (measured here to the bottom of the lid) is about 0.662 inches. The ratio D/H is 4.909, i.e., nearly 5.

It has been found that a cup so designed has a significant self-righting tendency, even when filled, without the addition of any weight to the cup bottom. However, according to the graph of FIG. 3, about 1 unit of base weight should be added to the bottom to assure consistent righting of the filled cup when tipped. For a cup of the size of the preferred embodiment, a unit of weight (x-axis scale of FIG. 3) is about 25 grams. The units might be larger with larger cups. Thus, a steel disc 36 is placed in the cup base and is sealed by plastic disc 38. In the illustrated embodiment, disc 36 weighs less than 30 grams (actually about 28.2 grams) and the total cup weight is less than 80 grams (actually about 78.3 grams), the cup with the lid in place being designed to hold approximately 6 (i.e., 6.25) fluid ounces.

As shown in FIG. 3, however, changes in the D/H ratio greatly affect the amount of base weight required to make the cup self-right under all degrees of fill. For example, with a ratio D/H of about 3.6, twice as much base weight is required (about 53 grams) than with the 5.0 ratio cup (about 28 grams). As explained previously, as the ratio drops even further to 2.5 (which is about the ratio of the prior art cups) the base weight required has increased dramatically so that a working cup with that ratio would weigh much too much to be practical.

Thus, the best results in terms of overall cup weight are when the D/H ratio is at least 4.0. At that ratio, about 40 grams of base weight would be required.

In the illustrated embodiment, the cup is made of polypropylene. The lid is made of high density polyethylene. The cup and the lid are injection molded, the cup normally being made with handles 40, as shown in FIG. 2. The absence of handles 40 or spout 28 will slightly decrease the base weight required, but for practical purposes, at least one handle and the spout would be used. After the cup is molded, weight 36 is placed in the base and polypropylene disc 38 is placed over the weight and is sealed to the base by ultrasonic sealing, encapsulating the steel disc 36 in the base of the cup.

In use, the cup 10 is filled with liquid and cover 20 is placed on the cup. Should the cup be tipped and the cup will right itself whether partially or completely filled. Advantageously, since the cup has a high D/H ratio, it has a significant self-righting tendency without any weighting, and as shown by FIG. 3, only a small weight is required to be added to assure consistent righting of the cup when filled or only partially filled, resulting in a lightweight cup, e.g., weighing less than 15 grams per fluid ounce of cup capacity. Thus the 6.25 fluid ounce cup as above described has a total weight of 78.3 grams or 12.52 grams per fluid ounce capacity of the cup, weight 36 being 28.2 grams or approximately one-third (36%) of the total cup weight. Thus, the present invention provides a reliably self-righting and permits a relatively light weight cup, (the prior art cups usually weigh between 125 and 160 grams) and a means to accurately determine the amount of base weight needed for a given cup. A cup, however, having an overall weight of less than 130 grams is acceptable.

Other embodiments of this invention will occur to those skilled in the art which are within the scope of the following claims.

What is claimed is:

1. A self-righting cup having a lower portion and an upper portion, said lower wall portion having a flat defining the bottom of said cup and a rounded sidewall extending upwardly therefrom, said upper portion having a sidewall which extends upwardly from said rounded sidewall of said lower portion, the ratio of the outer diameter of said cup at the point of intersection of said upper and lower portions to the effective height of said upper portion being at least 3 and the base of said cup having a weighting member the weight of which is effective in relation to said ratio to cause consistent self-righting of said cup when tipped.

2. The cup claimed in claim 1 in which said rounded sidewall is hemispherical and extends upwardly along a radius, said radius extending from a point on the vertical axis of said cup.

3. The cup claimed in claim 1 in which the effective height is the distance between the intersection of the upper and lower portions and the bottom of a lid.

4. The cup claimed in claims 1 or 2 in which the total weight of said cup including said weighting member does not exceed 130 grams.

5. The cup claimed in claim 1 in which the total weight of said cup including said weighting member is less than 15 grams per fluid ounce of cup capacity.

6. The cup claimed in claims 1 or 5 in which the weight of said weighting member is no greater than 40 grams.

7. The cup claimed in claim 1 in which the relationship between said ratio and the minimum weight of a weighting member effective to cause consistent self-righting of said cup is an exponential curve of inverse proportionality which approaches zero weight for high ratios above 7 and which substantially increases as to weight for low-ratios below 4 and said weight of said weighting member is at least as great as that indicated at the point on said curve corresponding to said ratio of said cup.

* * * * *